US007896759B2

(12) United States Patent
Jackson

(10) Patent No.: US 7,896,759 B2
(45) Date of Patent: Mar. 1, 2011

(54) TRAINING MAT AND METHOD OF TEACHING CONTROLLED DIRECTIONAL HITTING OF A BASEBALL OR SOFTBALL

(76) Inventor: Ron Jackson, Fayetteville, GA (US)

( * ) Notice: Subject to any disclaimer, the term of this patent is extended or adjusted under 35 U.S.C. 154(b) by 255 days.

(21) Appl. No.: 11/870,214

(22) Filed: Oct. 10, 2007

(65) Prior Publication Data

US 2008/0102993 A1 May 1, 2008

Related U.S. Application Data

(60) Provisional application No. 60/862,818, filed on Oct. 25, 2006.

(51) Int. Cl.
*A63B 69/00* (2006.01)

(52) U.S. Cl. ..... 473/452; D21/780

(58) Field of Classification Search ..... 473/452, 473/422, 417, 451, 500; D21/780; 434/250
See application file for complete search history.

(56) References Cited

U.S. PATENT DOCUMENTS

| | | | | | |
|---|---|---|---|---|---|
| 233,482 | A * | 10/1880 | Long | 283/117 |
| 1,815,443 | A * | 7/1931 | Mitchell | 434/250 |
| 2,158,475 | A * | 5/1939 | Montine | 434/250 |
| 3,341,199 | A * | 9/1967 | Madsen | 473/499 |
| 3,979,116 | A * | 9/1976 | Matchick | 473/452 |
| 4,463,950 | A | 8/1984 | Elkin | |
| 4,915,387 | A | 4/1990 | Baxstrom | |
| 5,042,814 | A | 8/1991 | Bennett | |
| 5,330,176 | A * | 7/1994 | Cagney, Jr. | 473/452 |
| 5,536,004 | A | 7/1996 | Wiseman et al. | |
| 5,642,880 | A | 7/1997 | Wiseman et al. | |
| 5,645,494 | A | 7/1997 | Dionne et al. | |
| 6,386,996 | B1 * | 5/2002 | Foster | 473/452 |
| D479,295 | S * | 9/2003 | Vesledahl | D21/780 |
| 7,090,599 | B2 | 8/2006 | Hedgepath | |
| 7,175,550 | B1 | 2/2007 | Bellah, Jr. et al. | |
| 2005/0266937 | A1 * | 12/2005 | Henning | 473/451 |

OTHER PUBLICATIONS

*Ex. Parte Breslow 192* USPQ 431, 1975,3 pages.*

* cited by examiner

*Primary Examiner* — Gene Kim
*Assistant Examiner* — Mike Chambers
(74) *Attorney, Agent, or Firm* — Barlow, Josephs & Holmes, Ltd.

(57) ABSTRACT

A training mat for teaching controlled directional hitting of a ball. The mat consisting of a home plate zone, a plurality of equally spaced pitching lanes defined by a plurality of lines extending longitudinally through home plate. The pitching lanes including at least an inside lane defining the ball path of an inside pitch and at least an outside lane defining the ball path of an outside pitch. Each lane having a predetermined ball contact location defined by a marking indicia s the respective lane. The ball contact locations being configured and arranged to facilitate hitting of a baseball to a predetermined field location.

4 Claims, 12 Drawing Sheets

TRAINING MAT AND METHOD OF TEACHING CONTROLLED DIRECTIONAL HITTING OF A BASEBALL OR SOFTBALL

BACKGROUND

The instant invention generally relates to athletic training aides and more particularly to a training mat configured and arranged to improve a player's controlled directional hitting of a baseball or softball depending on the trajectory of the baseball relative to home plate.

The key to being successful as an offensive baseball player is the ability to successfully hit or make proper contact with pitched or positioned baseballs. The ability to successfully hit a baseball begins with proper balance at home plate and thus it is critical that baseball players learn the basic batting stance. Once the basic batting stance is mastered, the baseball player typically improves upon their hitting technique by practicing hitting baseballs off of a tee or baseballs pitched to the player in a controlled environment. As with any sport or other physical activity, proficiency at a skill comes through sheer repetition.

One skill that is important for young players to develop is the ability to control the direction of the ball off the bat. In other words, to be able to hit the ball to a particular location on the field. This skill allows the player to take advantage of poorly positioned defensive players or "gaps" on the field.

The instant invention provides a training mat to facilitate teaching and learning the skill of controlled directional hitting of a baseball or softball as well as a method of teaching using the mat.

SUMMARY OF THE INVENTION

The preferred embodiment of the invention will be described in connection with baseball. However, the same inventive concepts are equally applicable to softball as well.

The training mat generally comprises a home plate zone and a plurality of equally spaced pitching lanes defined by a plurality of lines extending longitudinally through home plate. Preferably, home plate is divided into 5 equally spaced pitching lanes including an inside lane (1), middle inside (2), middle (3), middle outside (4) and outside (5), each lane generally defining the ball path of a pitch.

Each lane is provided with a predetermined ball contact location defined by a marking or indicia (a baseball) within the respective lane. The ball contact locations are configured and arranged to facilitate hitting of a baseball to a predetermined field location. Generally speaking the ball contact locations begin forward of home plate in the inside lane (1) and progressively move rearwardly onto home plate in the outside lane (5).

More specifically, the ball contact location of lane 1 is forward of home plate. A properly timed early swing combined with contact in front of the plate will result in a ball directed toward left field, i.e. controlled directional hitting. The ball contact location of lane 5 is on the middle outside of home plate. Conversely, a properly timed late swing combined with contact over the plate will result in a ball directed toward right field.

The mat further includes a back foot zone, front foot zone and stride zone to also help with proper batting stance and position relative to home plate.

In use, a method of teaching and/or learning controlled directional hitting comprises providing the above-described mat and practicing hitting baseballs while standing on the mat and attempting to make contact with the baseball at the respective ball contact locations. As a first step in learning the skill, it is beneficial for the player to begin by using a batting tee to control the location of ball contact within the respective lane. The player or instructor would place the tee on the respective marking indicia in lane 1 (inside pitch—hit to left field), and repetitively hit the ball off the tee learning the feel and timing of hitting the ball into left field. The player would then progressively move the tee from lane 1 to lane 2 and repeat, learning the feel and timing of hitting the ball into left center. The process is repeated through all of the lanes for as many times as it takes to learn the skill.

As a next step in the process, the player will begin to hit balls soft-tossed from the side into the respective lanes by a coach, and then pitched from the front down the lanes. By repeating the practice steps over and over and using the mat to direct the proper contact location, the player will gradually learn to identify the ball trajectory of a particular pitch and then be able to properly time their swing to direct the ball as desired.

A pitching strip may also be used in conjunction with the training mat. The pitching strip is divided into seven equally spaced pitching locations representing strike and ball locations. In one embodiment, the pitching strip is positioned over the home plate zone of the training mat. The ball locations are two outside lanes representing the inside ball marked B-I and the outside ball marked B-O. The strike locations are five remaining lanes marked 1-5 which represent inside, middle, and outside strikes. Alternatively, the pitching strip may have 5 or 6 lanes for softball pitchers due to the larger size of the softball. Also, the pitching strip may be used by umpires to facilitate calling of strikes and balls.

In use, a method of teaching and/or learning controlled hitting and pitching comprises providing the above-described training mat and practicing hitting baseballs while standing on the mat and attempting to make contact with the baseball at the respective ball contact locations. At the same time, the pitcher throws baseballs to a designated pitching location on the pitching strip. When the instructor calls out for an inside strike—lane 1, the pitcher would throw the baseball to pitching location 1, as seen on the pitching strip, and the hitter would look for a contact location at the baseball marked 1. By teaching controlled hitting and pitching using the training mat, the instructor can teach more than one person at a time. The process is repeated through all of the lanes for as many times as it takes to learn the skill.

Accordingly, among the objects of the instant invention are: the provision of a baseball training mat configured and arranged to improve a player's controlled directional hitting of a baseball depending on the trajectory of the baseball relative to home plate; and the provision of a method of teaching controlled directional hitting comprising providing a training mat, and using the mat during practice to learn the proper ball contact locations.

BRIEF DESCRIPTION OF THE DRAWINGS

Other objects, features and advantages of the invention shall become apparent as the description thereof proceeds when considered in connection with the accompanying illustrative drawings. In the drawings which illustrate the best mode presently contemplated for carrying out the present invention.

DETAILED DESCRIPTION OF THE PREFERRED EMBODIMENT

Figure 1:
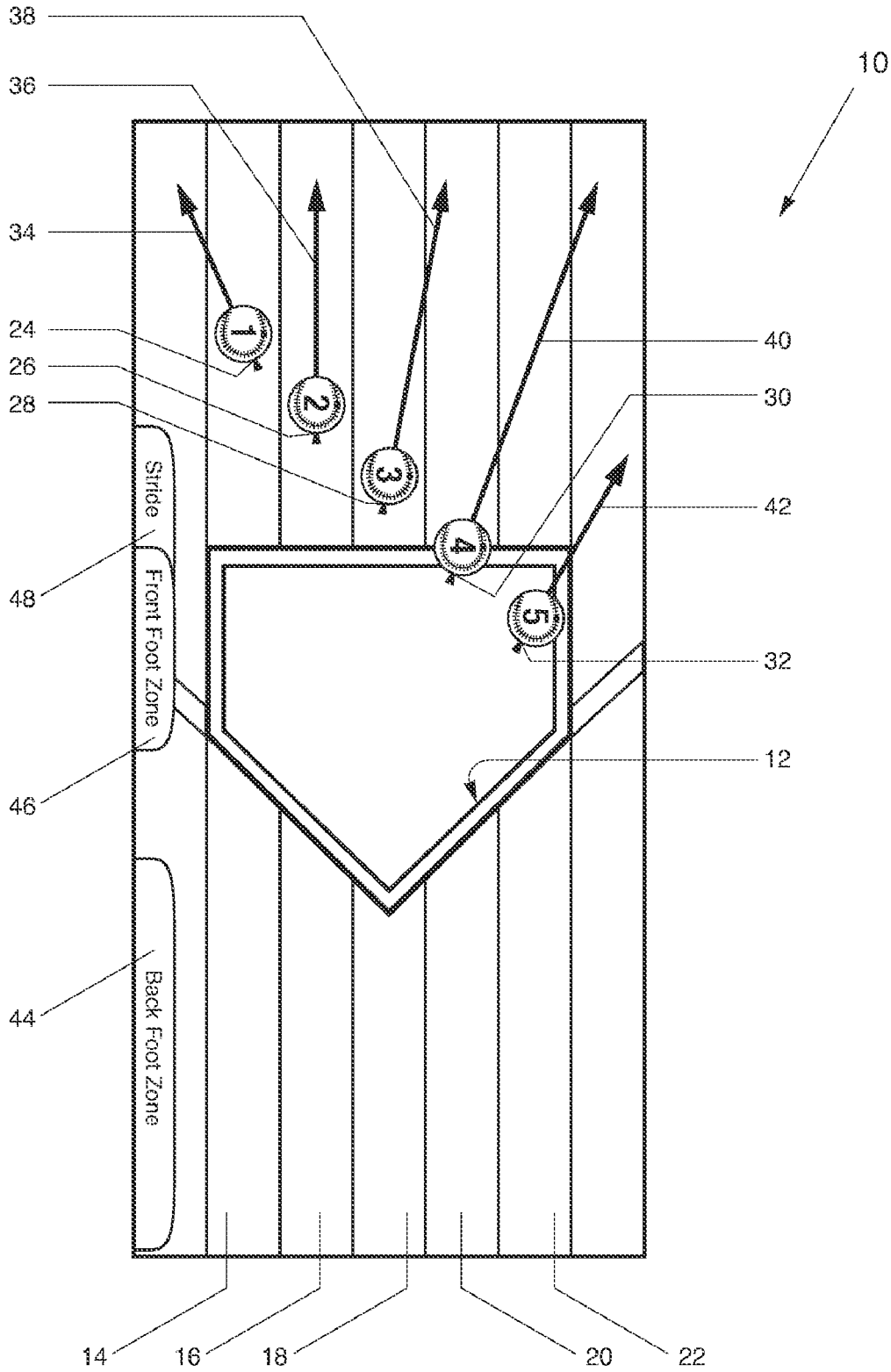
FIG. 1 is a plan view of the training mat of the present invention showing the proper ball contact positions to control the direction of the baseball off the bat.

Referring now to the drawings, the training mat of the instant invention is illustrated and generally indicated at 10 in FIGS. 1-12. As will hereinafter be more fully described, the instant invention provides a training mat 10 to facilitate teaching and learning the skill of controlled directional hitting of a baseball or softball as well as a method of teaching using the mat 10.

Figure 11:
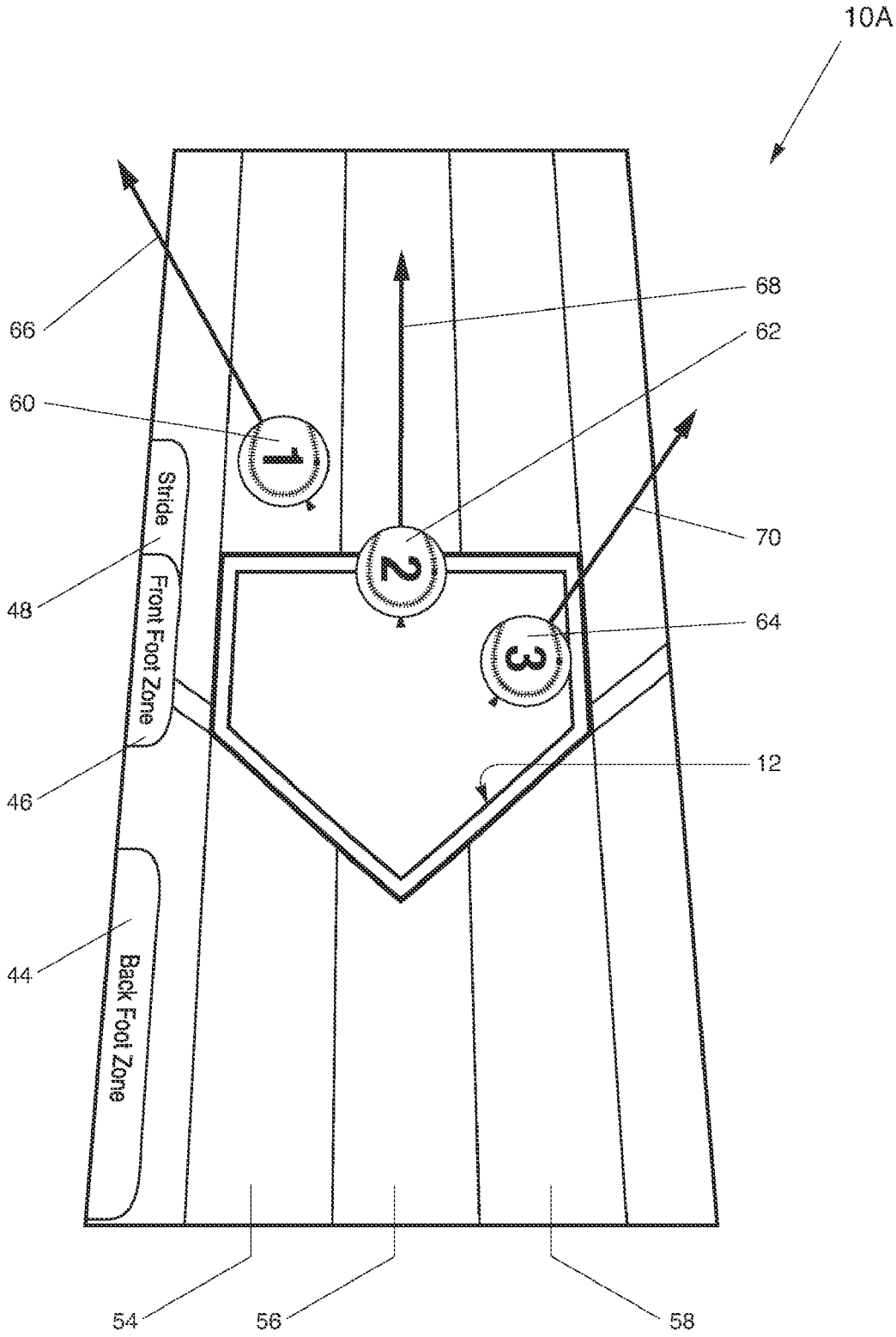
FIG. 11 is a plan view showing a preferred configuration for a softball mat.

Now referring to FIG. 1, the training mat 10 generally comprises a home plate zone 12 and a plurality of equally spaced pitching lanes 14, 16, 18, 20, 22 defined by a plurality of lines extending longitudinally through home plate 12. Preferably, for the training mat 10, home plate zone 12 is divided into five equally spaced pitching lanes including an inside lane 14, middle inside 16, middle 18, middle outside 20 and outside 22, each lane generally defining the ball path of a pitch. Referring briefly to FIG. 11, a softball mat 10A would be divided into either 3 or 4 lanes because of the larger size of a softball.

Turning back to FIG. 1, each lane 14,16,18,20,22 is provided with a predetermined ball contact location 24, 26, 28, 30, 32 defined by a marking or indicia (a baseball marked "1", "2", "3", "4", "5") within the respective lane 14,16,18,20,22. The ball contact locations 24, 26, 28, 30, 32 are configured and arranged to facilitate hitting of a baseball to a predetermined field location. The general direction of the ball in play is identified by an arrow 34, 36, 38, 40, 42 extending through the ball contact location 24, 26, 28, 30, 32. Generally speaking the ball contact locations 24, 26, 28, 30, 32 begin forward of home plate zone 12 in the inside lane 14 and progressively move rearwardly onto home plate zone 12 in the outside lane 22.

More specifically, the ball contact location marked "1" 24 of inside lane 14 is forward of home plate zone 12. A properly timed early swing combined with contact in front of the home plate zone 12 will result in a baseball directed toward left field, i.e. controlled directional hitting in the direction of arrow 34. The ball contact location marked "5" 32 of outside lane 22 is positioned on home plate zone 12. Conversely, a properly timed late swing combined with contact over the home plate zone 12 will result in a baseball directed toward right field, i.e. controlled directional hitting in the direction of arrow 42. Based upon the desired direction of the baseball after hitting the baseball, i.e. left, left-center, center, center-right, and right, the hitter can adjust the timing of his swing (earlier or later) to contact the ball at the appropriate ball contact location (marked 1-5) in its respective lane 14, 16, 18, 20, 22.

The training mat 10 further includes a back foot zone 44, front foot zone 46 and stride zone 48 to also help with proper batting stance and position relative to home plate zone 12. It should be noted the back foot zone 44, front foot zone 46, and stride zone 48 can be reversed to the opposite side of the training mat 10 to accommodate a left-handed hitter.

In use, a method of teaching and/or learning controlled directional hitting comprises providing the above-described training mat 10 and practicing hitting baseballs while standing on the mat 10 and attempting to make contact with the baseball at the respective ball contact locations 24, 26, 28, 30, 32.

Figure 2:
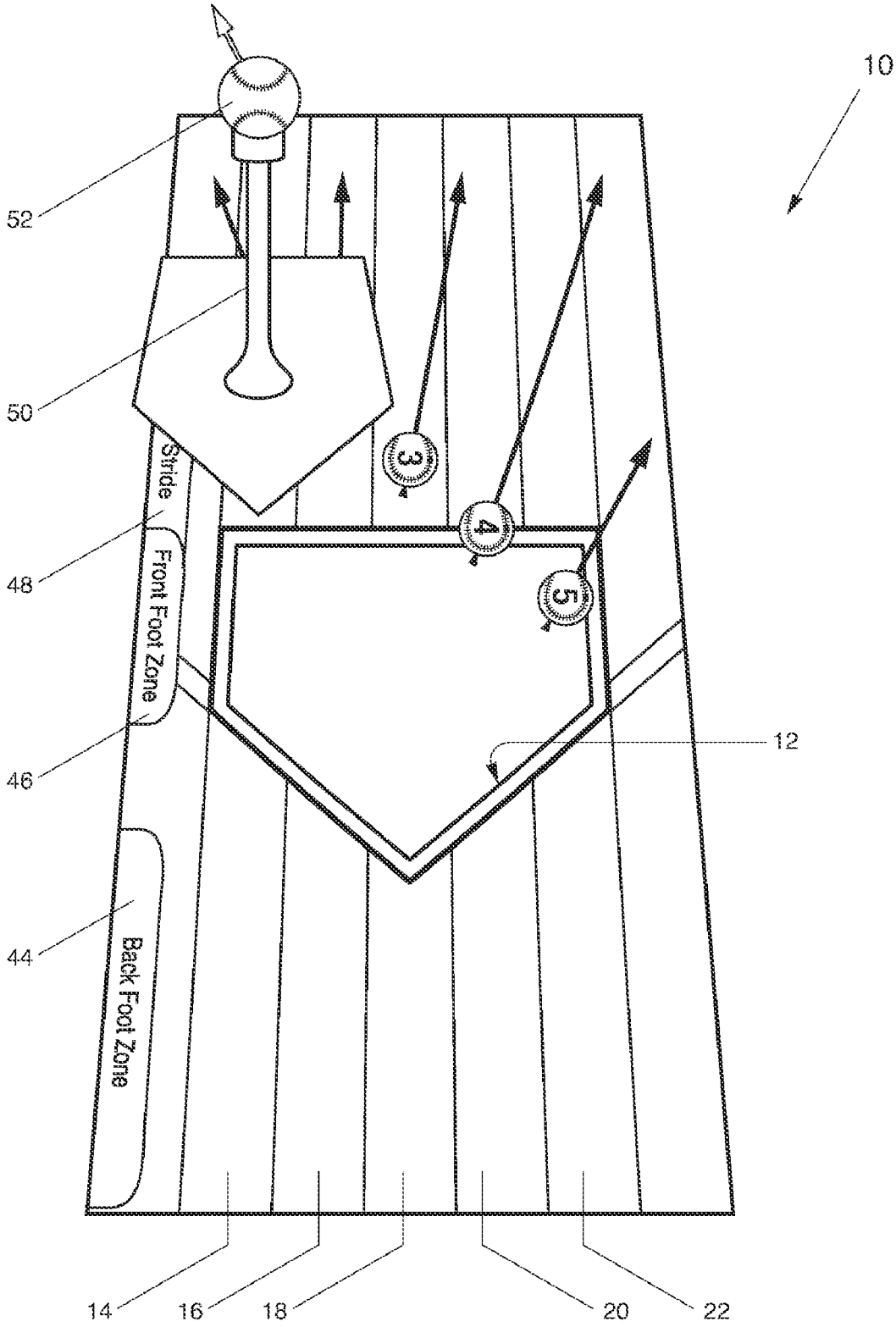
FIG. 2 is a perspective end view of the training mat of FIG. 1 showing placement of a tee on a mat at a first contact location.
Figure 3:
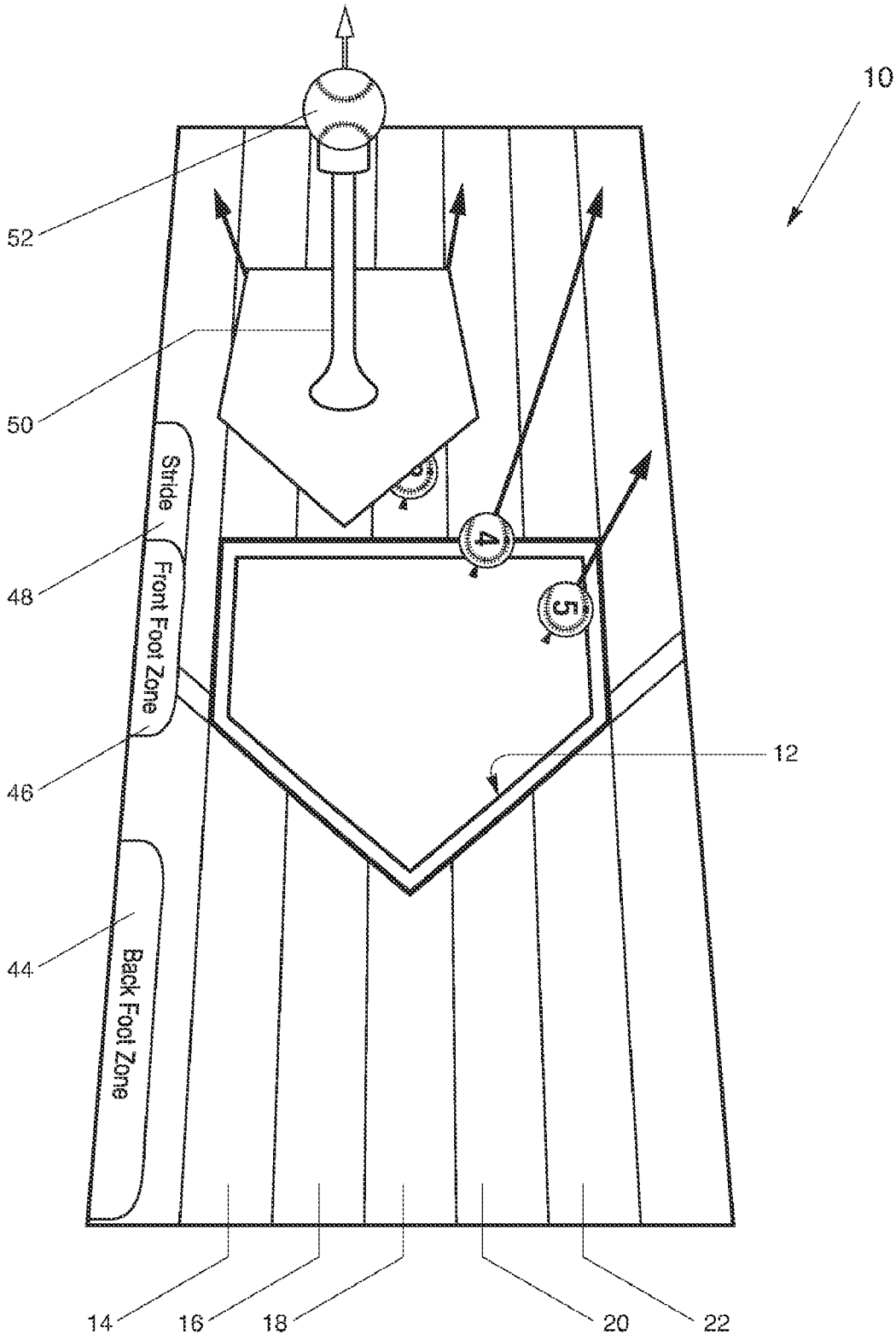
FIG. 3 is a perspective end view of the training mat of FIG. 1 showing placement of a tee on a mat at a second contact location.
Figure 4:
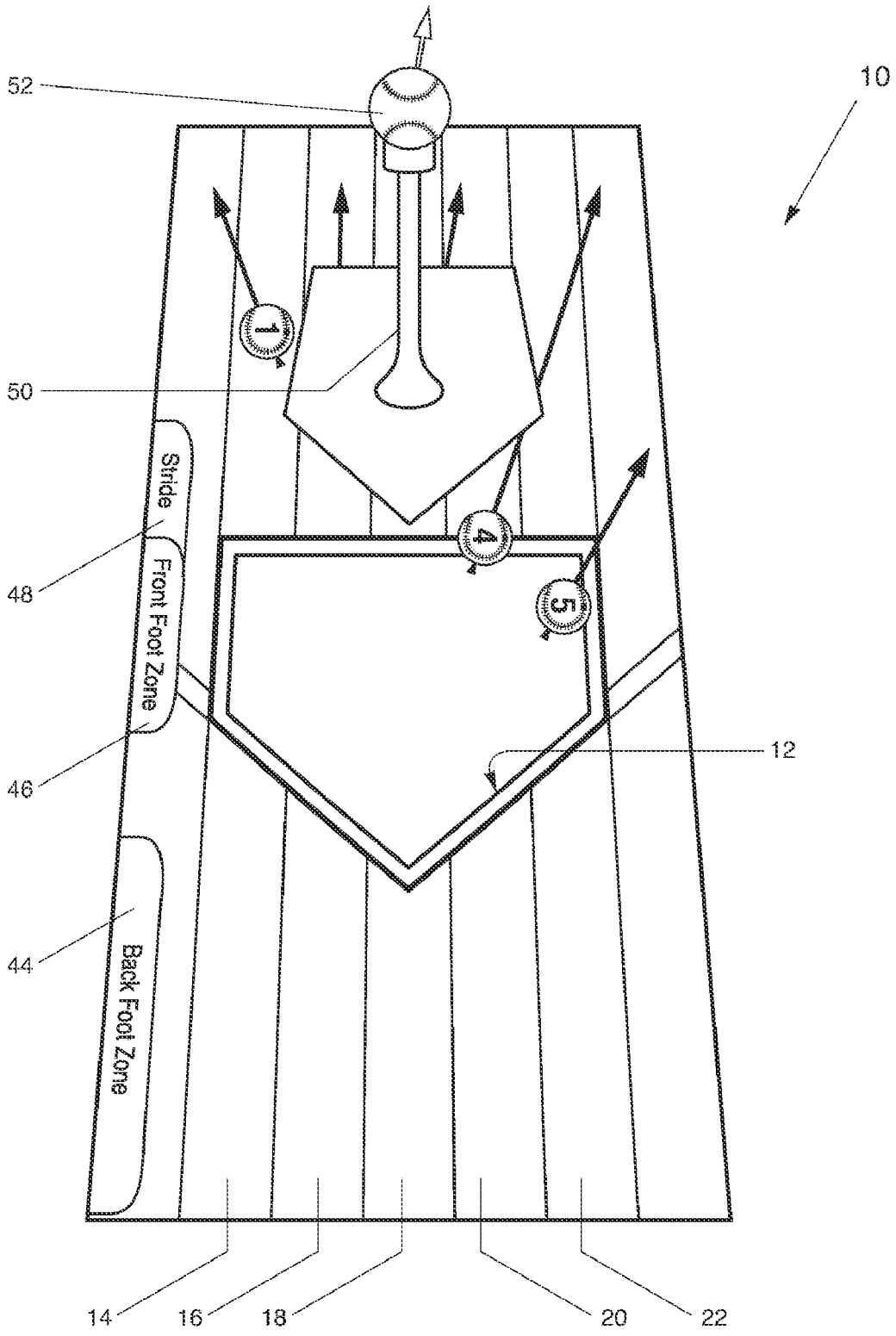
FIG. 4 is a perspective end view of the training mat of FIG. 1 showing placement of a tee on a mat at a third contact location.
Figure 5:
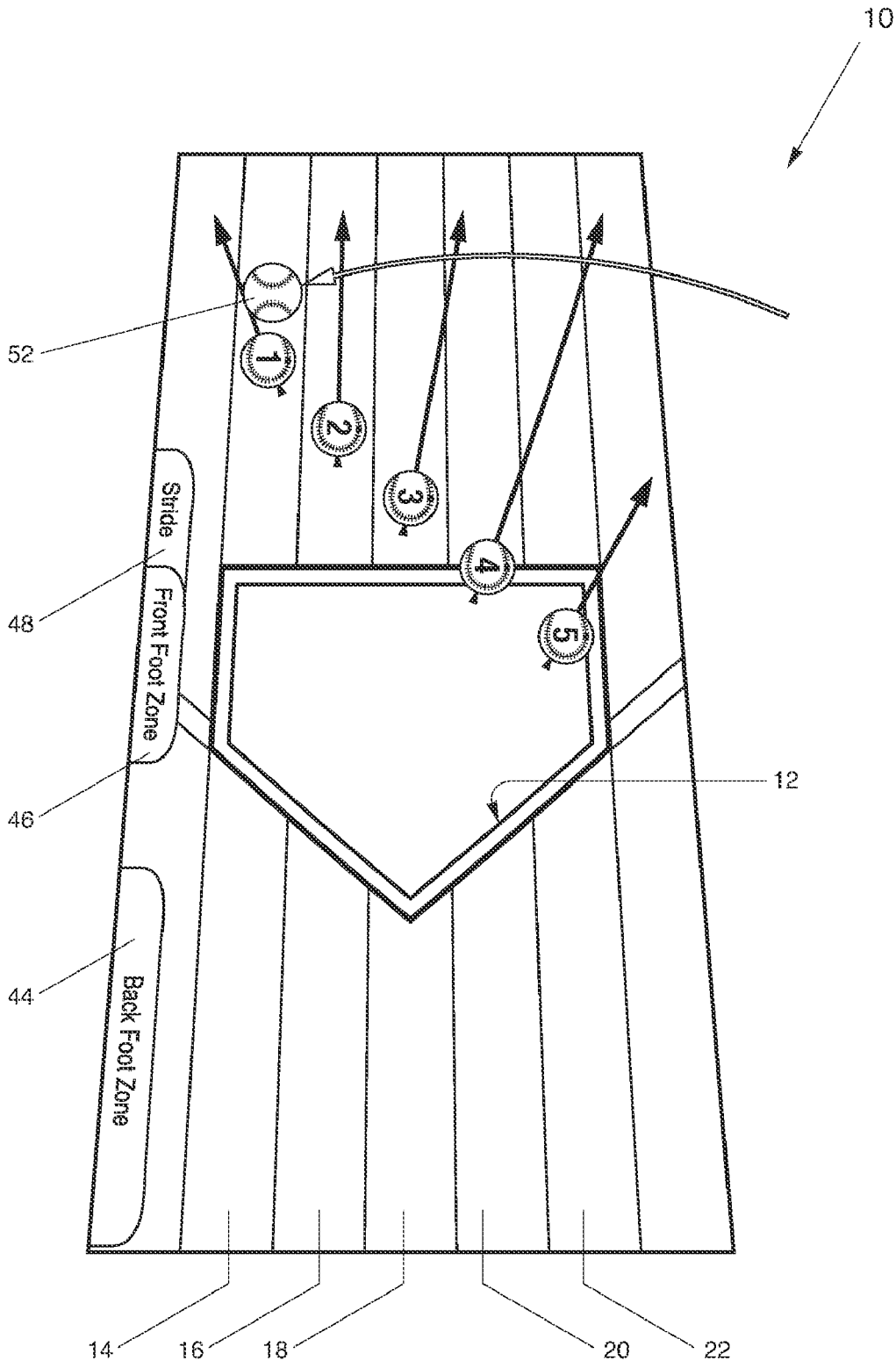
FIG. 5 is a perspective end view of the training mat of FIG. 1 showing a soft toss of a baseball over the mat into the first marked lane.
Figure 6:
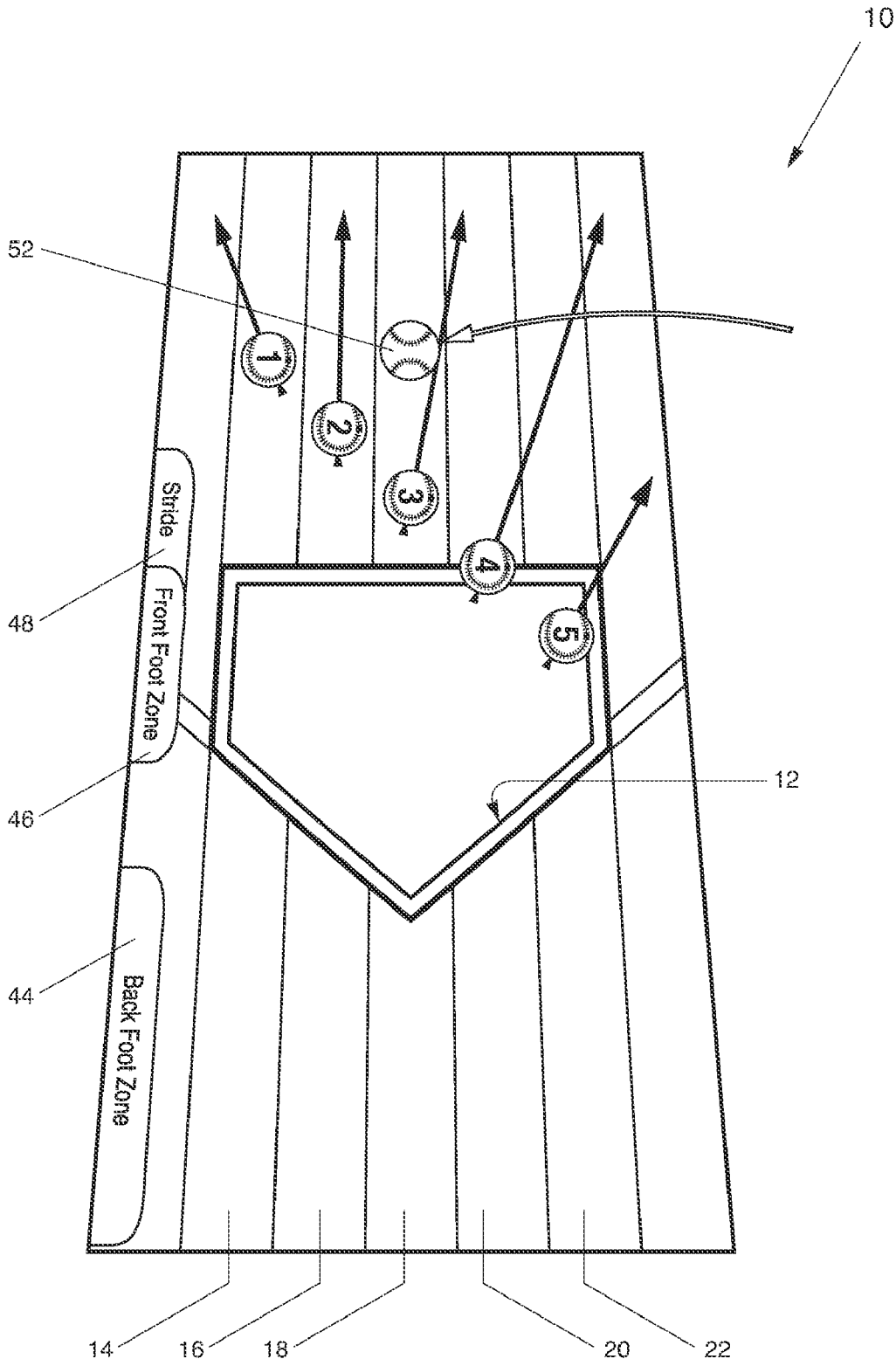
FIG. 6 is a perspective end view of the training mat of FIG. 1 showing soft toss of a baseball over the mat into the third marked lane.
Figure 7:
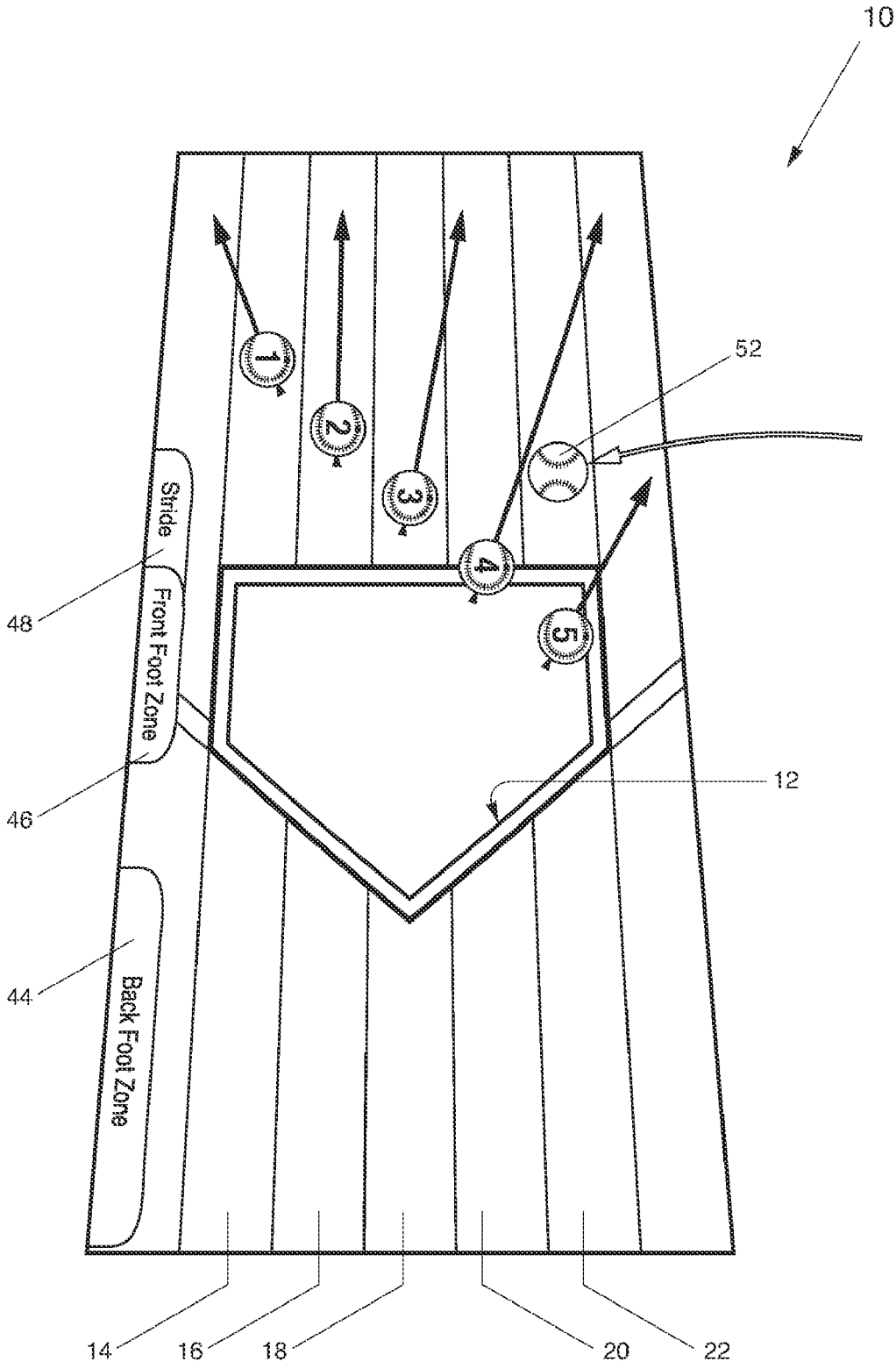
FIG. 7 is a perspective end view of the training mat of FIG. 1 showing soft toss of a baseball over the mat into the fifth marked lane.

Turing now to FIGS. 2-4, as a first step in learning the skill of hitting, it is beneficial for the player to begin by using a batting tee 50 to control the location of ball contact 24, 26, 28, 30, 32 within the respective lane 14, 16, 18, 20, 22. The player or instructor would place the tee 50 on the respective ball contact location marked "1" 24 (inside pitch—hit to left field) (FIG. 2), and repetitively hit the ball 52 off the tee 50, learning the feel and timing of hitting the ball 52 into left field. The player would then progressively move the tee 50 from ball contact location marked "1" 24 (FIG. 2) to ball contact location marked "2" 26 (FIG. 3) and repeat, ball contact location marked "2" 26 to ball contact location marked "3" 28 (FIG. 4) and repeat, gradually learning the feel and timing of hitting the ball 52 to a specific location on the field. The process is repeated through all of the lanes 14, 16, 18, 20, 22 for as many times as it takes to learn the skill.

Figure 8:
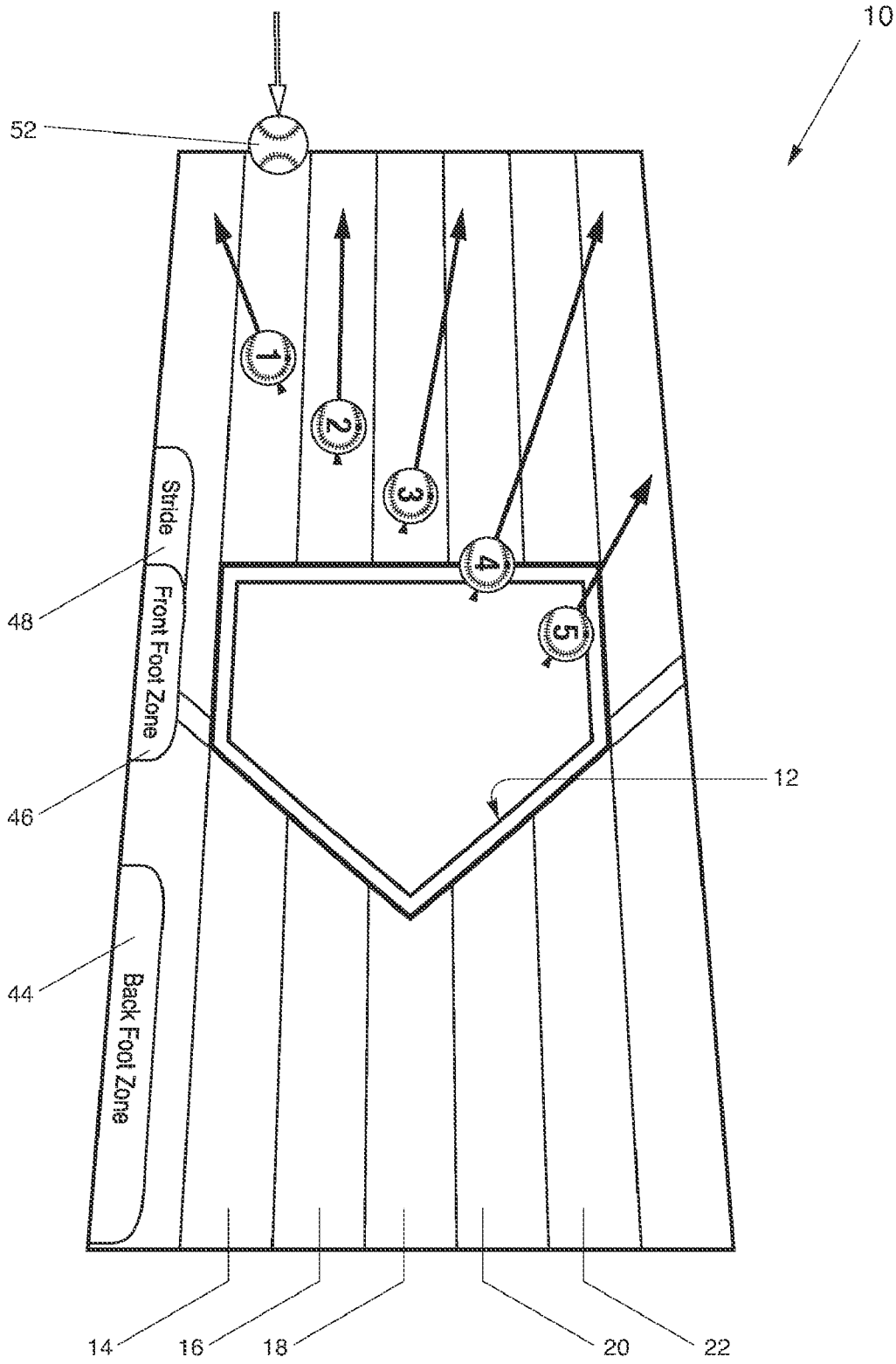
FIG. 8 is a perspective end view of the training mat of FIG. 1 showing pitching of a baseball in the first marked lane.
Figure 9:
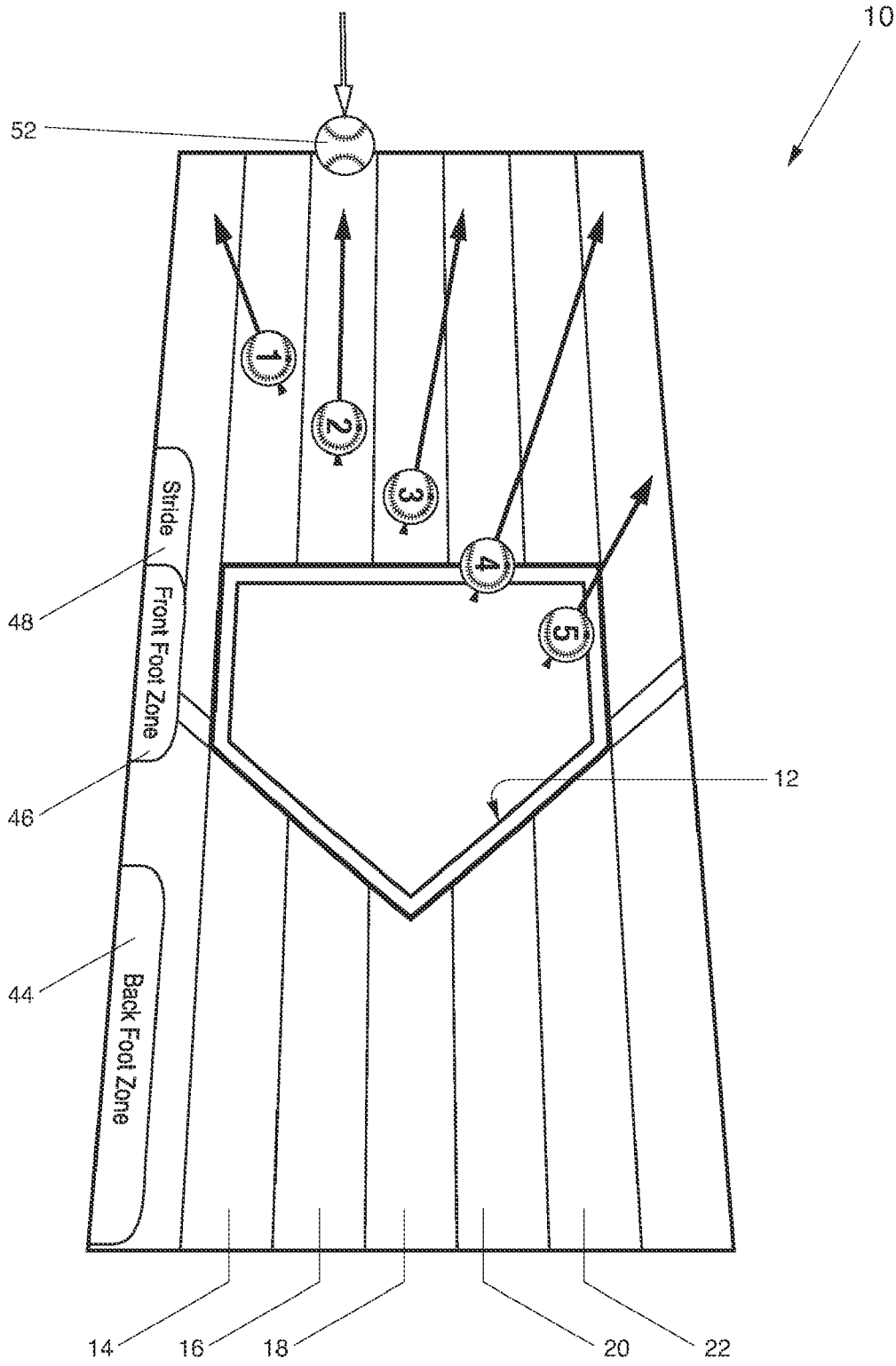
FIG. 9 is a perspective end view of the training mat of FIG. 1 showing pitching of a baseball in the second marked lane.
Figure 10:
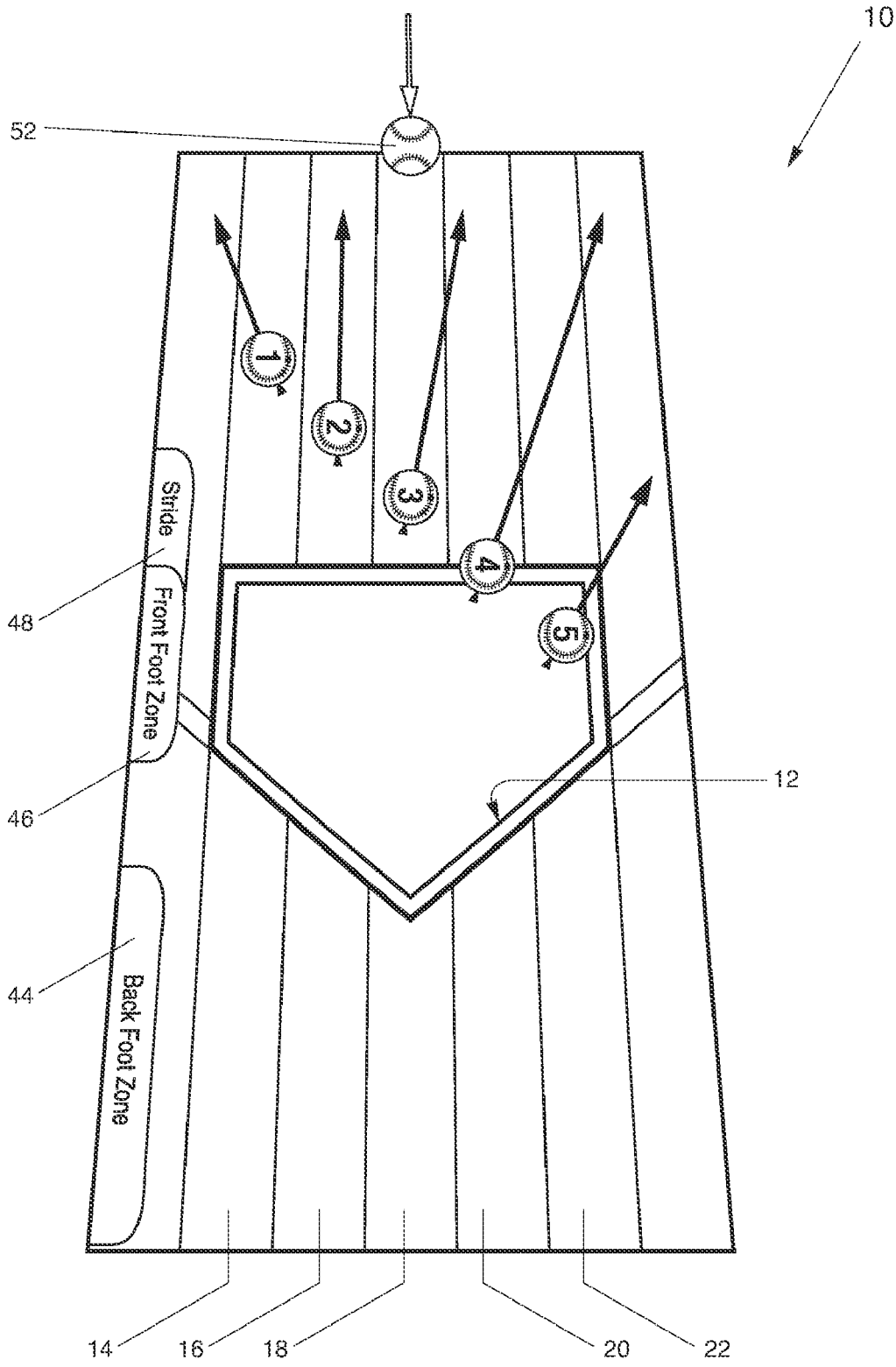
FIG. 10 is a perspective end view of the training mat of FIG. 1 showing pitching of a baseball in the third marked lane.

As a next step in the process, the player will begin to hit balls soft-tossed from a side into the respective lanes 14, 16, 18, 20, 22 (See FIGS. 5-7), and then pitched from the front down the respective lanes 14, 16, 18, 20, 22 (See FIGS. 8-10). FIGS. 8-10 show pitching of a ball 52 from a front of the training mat 10 down the respective lanes 14, 16, 18, 20, 22.

By repeating the practice steps over and over and using the training mat 10 to direct the proper contact location 24, 26, 28, 30, 32 and emphasize the desired ball direction 34, 36, 38, 40, 42 the player will gradually learn to identify the ball trajectory of a particular pitch and then be able to properly time their swing to direct the baseball 52 as desired.

As indicated above, the training mat 10 is equally useful for a softball player as well. FIG. 11 illustrates a preferred embodiment of the mat 10A for teaching controlled hitting of a softball. It is noted that the size of a softball is larger and therefore home plate 12 is divided into 3 (or possibly 4) pitching lanes 54, 56, 58. Each lane 54, 56, 58 is provided with a predetermined ball contact location 60, 62, 64 defined by a marking or indicia (a softball marked "1", "2", or "3") 60, 62, 64 within the respective lane 54, 56, 58. The softball contact locations 60, 62, 64 are configured and arranged to facilitate hitting of a softball to a predetermined field location, such as left field, center field, or right field. The general direction of the ball in play is identified by an arrow 66, 68, 70 extending through the ball contact location 60, 62, 64. Generally speaking the ball contact locations 60, 62, 64 begin forward of the home plate zone 12 in the inside lane 54 and progressively move rearwardly onto the home plate zone 12 in the outside lane 58. The teaching method of controlled hitting of a softball is identical to that described hereinabove for a baseball.

The training mat 10 as illustrated in FIGS. 1-12 is configured and arranged for use by a right-handed batter. We note that the invention is not limited to a right-handed training mat 10, and that the concepts are equally applicable to a left-handed training mat wherein all of the markings and indicia are simply a reverse symmetrical image thereof.

Figure 12:
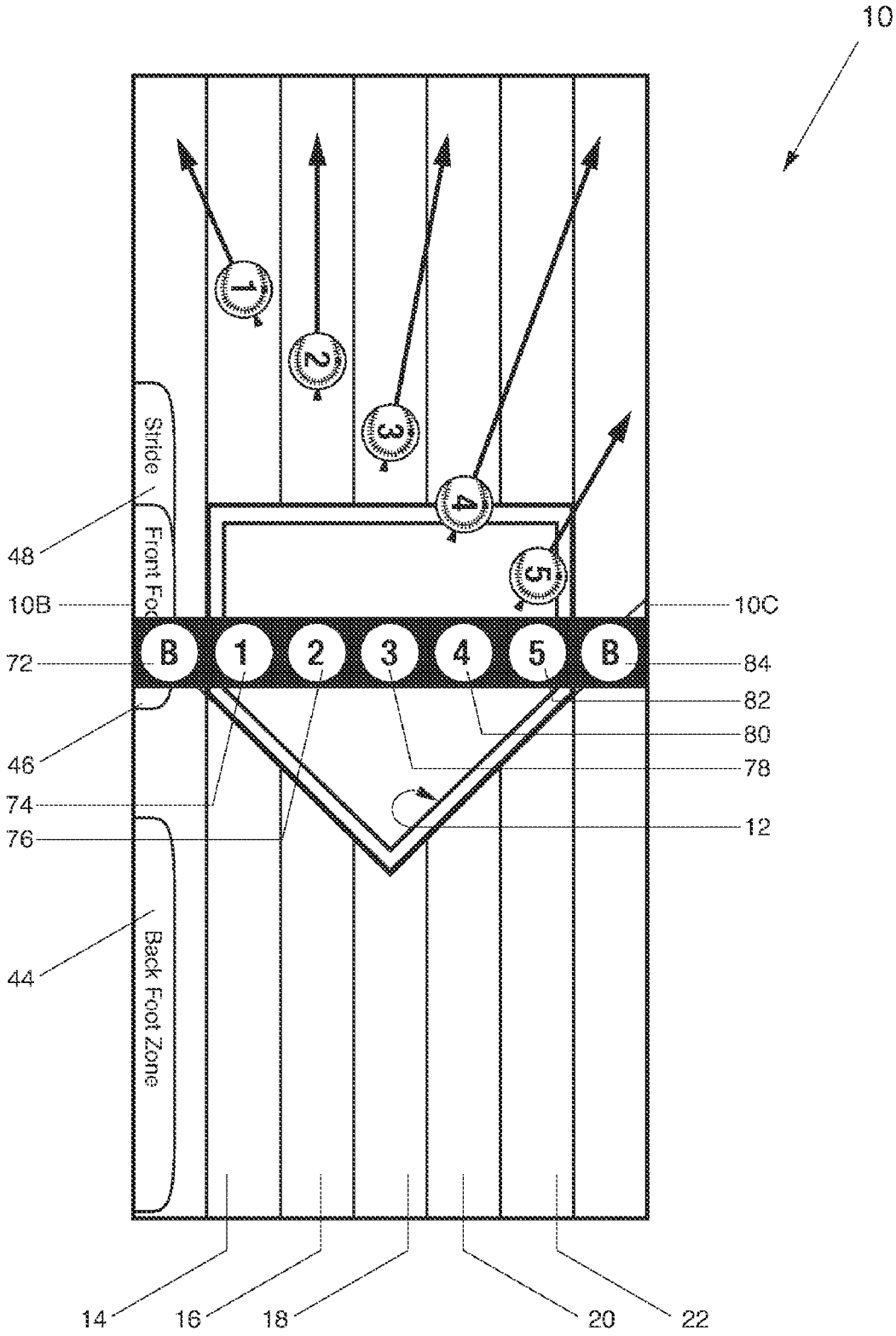
FIG. 12 is a perspective end view of the training mat of FIG. 1 showing a pitching strip positioned over a home plate zone of the training mat.

A pitching strip 70, as shown in FIG. 12, may be used in conjunction with the training mat 10 for teaching the controlled directional hitting of a baseball, and/or, teaching controlled directional pitching of a baseball. In one embodiment, the pitching strip 70 is positioned over the home plate zone 12 of the training mat 10. Alternatively, the pitching strip 70 may be positioned forward of the home plate zone 12 or rearward of the home plate zone 12 of the training mat 10 depending on the particular needs of the instructor.

The pitching strip 70 used in conjunction with the training mat 10 is divided into seven equally spaced baseball pitching locations 72, 74, 76, 78, 80, 82, 84 representing "strike" pitching locations 74, 76, 78, 80, 82 and ball pitching "locations" 72, 84. Generally speaking, the strike and ball locations 72, 74, 76, 78, 80, 82, 84 are transversely arranged over the home plate zone 12 from a left side 10B of the training mat 10 to right side 10C of the training mat 10. The "ball" pitching locations 72, 84 are two outside pitches representing the inside ball location 72 marked as "B-I" and the outside ball location 84 marked as "B-O". The "strike" pitching locations 74, 76, 78, 80, 82 are an inside strike marked 74 as "2", middle inside strike 76 marked as "3", middle strike 78 marked as "4", middle outside strike 80 marked as "5" and outside strike 82 marked as 6, each pitching location 72, 74, 76, 78, 80, 82, 84 generally defining the ball path of a pitch. A properly executed throw of a baseball into the respective strike or ball locations 72, 74, 76, 78, 80, 82, 84 will teach proper control of the baseball's direction and proximity to the home plate zone 12. It should be noted that the pitching strip 70 may also be used for teaching the controlled directional pitching of a softball which would be divided into either 5 or 6 lanes because of the larger size of a softball.

In use, a method of teaching and/or learning controlled directional pitching comprises providing the above-described mat 10 and practicing pitching baseballs while standing on a pitching mound and attempting to locate the baseball at the respective strike and ball locations 72, 74, 76, 78, 80, 82, 84 of the pitching strip 70 upon command. The pitching strip 70 will assist pitcher's visualize where the pitch should be thrown after hearing a verbal command about the intended pitch location 72, 74, 76, 78, 80, 82, 84 from an instructor. The verbal commands will consist of the intended pitching locations (B-I, 1, 2, 3, 4, 5, B-O). By repeating the practice steps over and over and using the mat 10 in conjunction with the pitching strip 70 to direct the proper strike and ball location 72, 74, 76, 78, 80, 82, 84, the player will gradually learn to identify the ball trajectory of a particular pitch.

The pitching strip 70, as shown in FIG. 12, may also be used in conjunction with the training mat 10 for teaching the calling of "balls" and "strikes" by an umpire. The pitching strip 70 indicates ball and strike locations 72, 74, 76, 78, 80, 82, 84 relative to the home plate zone 12. The umpire may use the pitching strip 70 to guide his calling of either "balls" or "strikes" during practice. For example, if the pitcher throws an inside strike at pitching location 74 marked 1, the umpire will call a "strike". If the pitcher throws an outside ball 84 at pitching location marked B-O, the umpire will call a "ball".

In use, a method of teaching and/or learning calling balls and strikes is providing the above-described mat 10 and pitching strip 70, having a pitcher throw baseballs while standing in front of the mat, and having the umpire attempting to call the respective strike and ball locations 72, 74, 76, 78, 80, 82, 84 consistently. By repeating the practice steps over and over and using the pitching strip 70 in calling the proper strike and ball, the umpire will gradually learn to uniformly and consistently identify a strike and ball. As indicated above, the mat 10 and pitching strip 70 are equally useful in teaching the calling of strikes and balls for a softball umpire.

In an alternative embodiment, the pitching strip 70 described above may be adapted for use without the training mat 10 described above. For example, the pitching strip 70 maybe placed directly on ground or over a home plate without the aid of the training mat 10.

We note that the pitching strip 70 is illustrated for use with a right-handed batter, but it should be evident that the concepts are equally applicable to a left-handed training mat wherein the markings and indicia are reversed.

In summary, the use of both the training mat 10 and pitching strip 70 will allow for simultaneous teaching of controlled hitting, pitching and/or umpiring. Both the pitcher and batter will hear a verbal command from an instructor, and each will try to visualize a direction and position of the ball. An umpire can call a strike or ball once the pitch is thrown by a pitcher with the aid of the pitching strip 70. As a result, one instructor or more may observe and teach proper hitting, pitching, and umpiring during the same session. For all of the reasons stated above, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method for teaching controlled directional hitting of a ball in the game of baseball or softball, said method comprising the steps of:

providing a training mat, said training mat having a plurality of indicia on a top surface thereof, said indicia including a home plate having a first side edge defined as an inside edge of the home plate, and a second side edge defined as an outside edge of the home plate, and further having a front edge, a plurality of ball contact locations each defined by a circular marking, said plurality of ball contact locations being arranged in a linear configuration starting at a first ball contact location positioned forwardly of said front edge of said home plate and adjacent to said first side edge of said home plate, and progressing linearly rearwardly at an angle toward said second side edge of said home plate, and ending at a last ball contact location positioned rearwardly of said front edge of said home plate and adjacent said second side edge of said home plate, said plurality of ball contact locations including at least one additional ball contact location positioned in linear alignment with and between said first and last ball contact locations, each of said ball contact locations further including a directional arrow extending from the ball contact location indicating the proper direction of the ball after contact;

providing apparatus configured and arranged to position a ball in predetermined locations above said training mat, said training mat and said apparatus being used in said training method to teach proper ball contact location and proper swing timing for controlled directional hitting of a ball based on ball location relative to said home plate wherein contact between a bat swung by said batter and said ball positioned above one of said plurality of predetermined ball contact locations results in a ball directed off the bat in the general direction of the arrow indicia extending therefrom; repeatedly using said apparatus to position said ball above each of said ball contact locations on said training mat; and repeatedly hitting said ball positioned above each of said ball contact locations, whereby said batter becomes proficient at hitting said ball in each ball contact location.

2. The teaching method as claimed in claim 1 wherein said apparatus for positioning said ball is height adjustable, said method further comprising the step of repeatedly adjusting the height of said ball positioned above each of said ball contact locations, whereby said batter becomes proficient at hitting said ball at varying heights above each of said ball contact locations.

3. The teaching method as claimed in claim 1 wherein said apparatus comprises a batting tee, said step of repeatedly using said apparatus to position said ball above each of said ball contact locations on said training mat comprises repeatedly positioning said tee on each of said ball contact locations, and said step of repeatedly hitting said ball positioned above each of said ball contact locations comprises repeatedly hitting said ball from said tee.

4. The teaching method as claimed in claim 2 wherein said apparatus comprises a telescoping batting tee, said step of repeatedly using said apparatus to position said ball above each of said ball contact locations on said training mat comprises repeatedly positioning said tee on each of said ball contact locations, said step of repeatedly adjusting the height of said ball positioned above each of said ball contact locations comprises repeatedly adjusting the telescoping position of said tee above each of said ball contact locations, and said step of repeatedly hitting said ball positioned above each of said ball contact locations comprises repeatedly hitting said ball from said tee.

* * * * *